US006768626B1

(12) United States Patent
Hemmer

(10) Patent No.: US 6,768,626 B1
(45) Date of Patent: Jul. 27, 2004

(54) TRIP SYSTEM FOR AN ELECTRICAL SWITCH HAVING A FAVORABLE FORCE-PATH-CHARACTERISTIC

(75) Inventor: Aloysius Gerardus Majella Hemmer, Hengelo (NL)

(73) Assignee: Holec Holland N.V., Hengelo (NL)

( * ) Notice: Subject to any disclaimer, the term of this patent is extended or adjusted under 35 U.S.C. 154(b) by 0 days.

(21) Appl. No.: 09/869,828

(22) PCT Filed: Jan. 6, 2000

(86) PCT No.: PCT/NL00/00009

§ 371 (c)(1),
(2), (4) Date: Sep. 7, 2001

(87) PCT Pub. No.: WO00/41201

PCT Pub. Date: Jul. 13, 2000

(30) Foreign Application Priority Data

Jan. 6, 1999 (NL) ..... 1010974

(51) Int. Cl.[7] ..... H01H 47/00
(52) U.S. Cl. ..... 361/139; 361/143
(58) Field of Search ..... 361/139, 140, 361/141, 142, 143, 146, 147, 149, 93.1, 93.9; 335/78, 80

(56) References Cited

U.S. PATENT DOCUMENTS 3,914,720 A * 10/1975 Drubig ..... 335/14
4,568,207 A * 2/1986 Hara et al. ..... 400/124.18
4,728,917 A * 3/1988 Kimpel ..... 335/274
5,006,826 A * 4/1991 Knoben et al. ..... 335/35
5,024,543 A * 6/1991 Mitsuishi et al. ..... 400/124.18
5,280,882 A * 1/1994 Kamiya et al. ..... 137/883
5,574,416 A * 11/1996 Maruyama et al. ..... 335/78
5,864,271 A * 1/1999 Mader ..... 335/78

FOREIGN PATENT DOCUMENTS

| | | |
|---|---|---|
| DE | 1 639 196 | 5/1970 |
| DE | 42 40 031 A1 | 6/1994 |
| FR | 2 261 614 | 9/1975 |
| FR | 2 410 353 | 6/1979 |
| FR | 2 697 670 | 5/1994 |
| NL | 840343 A1 * | 6/1998 |

* cited by examiner

*Primary Examiner*—Brian Sircus
*Assistant Examiner*—Danny Nguyen
(74) *Attorney, Agent, or Firm*—Young & Thompson

(57) ABSTRACT

A trip system for an electrical switch comprises first and second magnetic circuits are formed by a yoke and an armature. The second magnetic circuit has a magnetic resistance in a first position of the armature, which resistance is higher than that of the first magnetic circuit and increases in the movement of the armature from the first to the second position.

18 Claims, 2 Drawing Sheets

TRIP SYSTEM FOR AN ELECTRICAL SWITCH HAVING A FAVORABLE FORCE-PATH-CHARACTERISTIC

BACKGROUND OF THE INVENTION

The invention relates to a trip system for an electrical switch, comprising a yoke of magnetic material, consisting of a yoke base part, a first yoke leg and a second supporting yoke leg, said first and second yoke legs extend in the same direction from the yoke base part, transversely thereto and in mutual spaced relation, an armature from magnetic material, bridging the free ends of the yoke lets and supported pivotably by the supporting yoke leg, a permanent magnetic, provided such that its magnetic field lines extend through a first magnetic circuit formed by the yoke and the armature, a coil mounted on the yoke and spring means engaging the armature, in which the armature is held in a first position under influence of the magnetic field of the permanent magnet against the spring force of the spring means, in which the armature lies against the free end of the first yoke leg and in which the armature can assume a second position under influence of the magnetic field developed by a current flowing through the coil and exceeding a predetermined limit value, in which the surfaces facing to each other of the armature and free end of the first yoke leg at a first air gap distance from each other.

DESCRIPTION OF THE RELATED ART

Such a trip system is known from the Dutch patent application 1004438.

Trip systems for electrical switches, for example earth leakage switches, have to serve the purpose to unlock a main switch mechanism biased by springs with minimum switching energy/costs or tuned switching energy, so that the earth leakage switch could be opened.

The above mentioned known trip system operates by unlocking a magnetic circuit closed by means of the permanent magnet. This magnetic circuit is formed by the two-leg yoke, the pivotable armature and the permanent magnet. The armature is arranged pivotable and thereby supported by a supporting yoke leg of the yoke, while between the other yoke leg and the armature an air gap is provided, which can be opened or closed by rotating the armature. The permanent magnet is provided in a recess of the other yoke leg. On one of the two yoke legs a coil is provided. A spring is arranged such between armature and yoke that said spring can provide the air gap opening force on the armature. The permanent magnet provides the air gap closing force. The spring is in the position of the armature in which this lies against the free end face of the first yoke leg, so that in this spring the energy is accumulated, by which a main switch mechanism can be unlocked. The pretension of the spring is just not high enough to remove the force exerted on the armature by the permanent magnetic field in the magnetic circuit and to open the air gap between armature and first yoke leg.

By exciting the winding the magnetic field from the permanent magnet is cancelled partly, by which the spring can open the air gap between armature and first yoke leg and thereby, can deliver the accumulated mechanical energy to a main switch mechanism. Thereby it is achieved that the trip system is unlocked with minimum energy.

This known trip system has, however, still the disadvantage that the more the energy is opened further, the spring detentions, by which the opening force on the armature decreases.

SUMMARY OF THE INVENTION

The invention has the object to provide a trip system of the kind mentioned above, in which said disadvantage is obviated, the accuracy of the trip system is further improved and the manufacturing is simplified as much as possible.

This object is achieved according to the invention, in that the magnet is included in a second circuit formed by the yoke and the armature, said circuit having a magnetic resistance in the first position of the armature, which resistance is higher than that of the first magnetic circuit and decreases in the movement of the armature from the first to the second position. Thereby the opening performance of the armature is improved and a more or less force-path-characteristic of the trip system is achieved, when this comes to action.

The magnetic resistance varying dependent on the armature movement compensates for the varying force of the spring means during the armature movement.

The varying magnetic resistance can be achieved by using an air gap in the second magnetic circuit arranged such that this air gap decreases when the spring force of the spring means on the armature decreases during the movement of the armature from the first position to the second position.

In a first embodiment the yoke base part is provided with a yoke base part extension extending beyond the supporting yoke leg and merging into a third yoke leg extending spaced from the supporting yoke leg and in the same direction thereof, in which a permanent magnet is added to the magnetic path of yoke base part extension and a third yoke leg and in which the armature is extended and overlaps the free end face of the assembly of yoke base part extension, third yoke leg and permanent magnet at a second air gap distance, when the armature is in the first position.

In a second embodiment the armature has two legs, the one armature leg of which bridging the space between the first yoke leg and the supporting yoke leg and the second armature leg of which extends transversely to the one armature leg and at a distance from the supporting yoke leg, in which a space remains between the faces facing to each other of the second armature leg and the supporting yoke leg for accommodating the permanent magnet with a second air gap.

BRIEF DESCRIPTION OF THE DRAWINGS

Preferable and advantageous embodiments of the invention are-described in sub claims.

The invention will be explained hereafter by reference to the drawings, in which.

DESCRIPTION OF THE PREFERRED EMBODIMENTS

Figure 1:
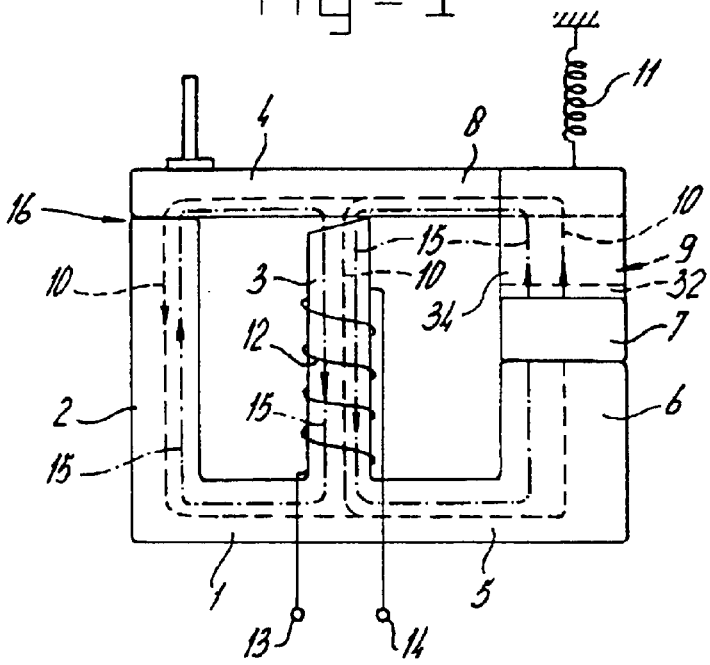
FIG. 1 shows schematically an embodiment of the invention.

The trip system shows schematically in FIG. 1 comprises a yoke of magnetic material consisting of a yoke base part 1, a first yoke leg 2 and a second supporting yoke leg 3. The trip system is provided further with an armature 4, supported pivotably or tiltably by the supporting yoke leg 3. The yoke base part 1, the first yoke leg 2, the armature 4 and the supporting yoke leg constitute a first magnetic circuit. A configuration and the operation of a trip system having such a single magnetic circuit is described for example in the Dutch patent application 1004438.

In order to obviate the disadvantages mentioned in the introductory part a second magnetic circuit is used according to the invention. The magnet is included in the second magnetic circuit formed by the yoke and the armature and which has a magnetic resistance in the first position, which is higher than that of the first magnetic circuit and which decreases during the movement of the armature from the first to the second position.

Figure 3:
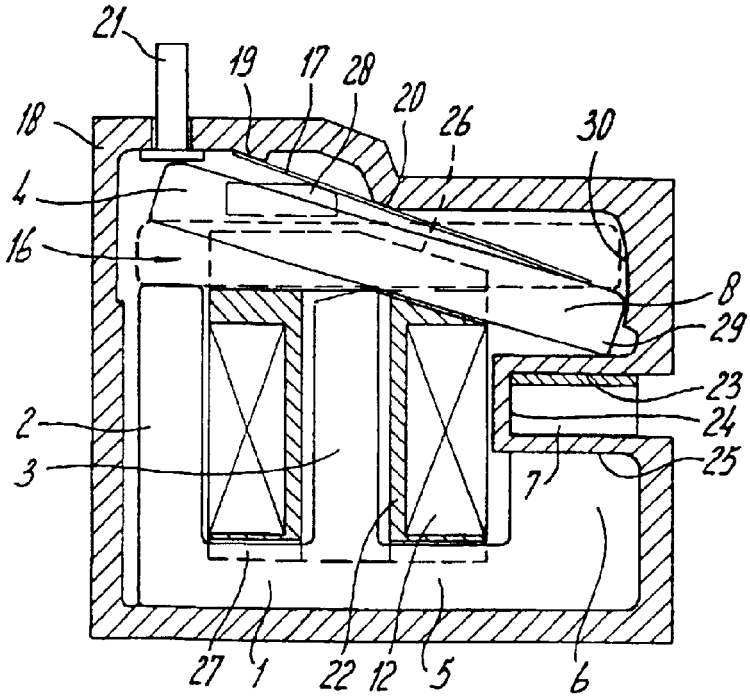
FIG. 3 illustrates an elaborated embodiment of the trip system according to the invention.
Figure 4:
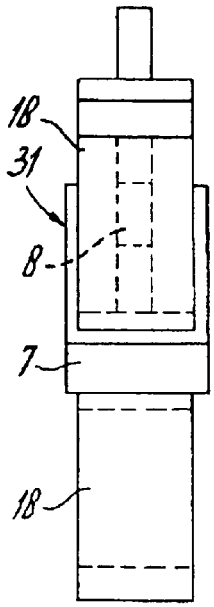
FIG. 4 represents a side view of the embodiment of FIG. 3.
Figure 5:
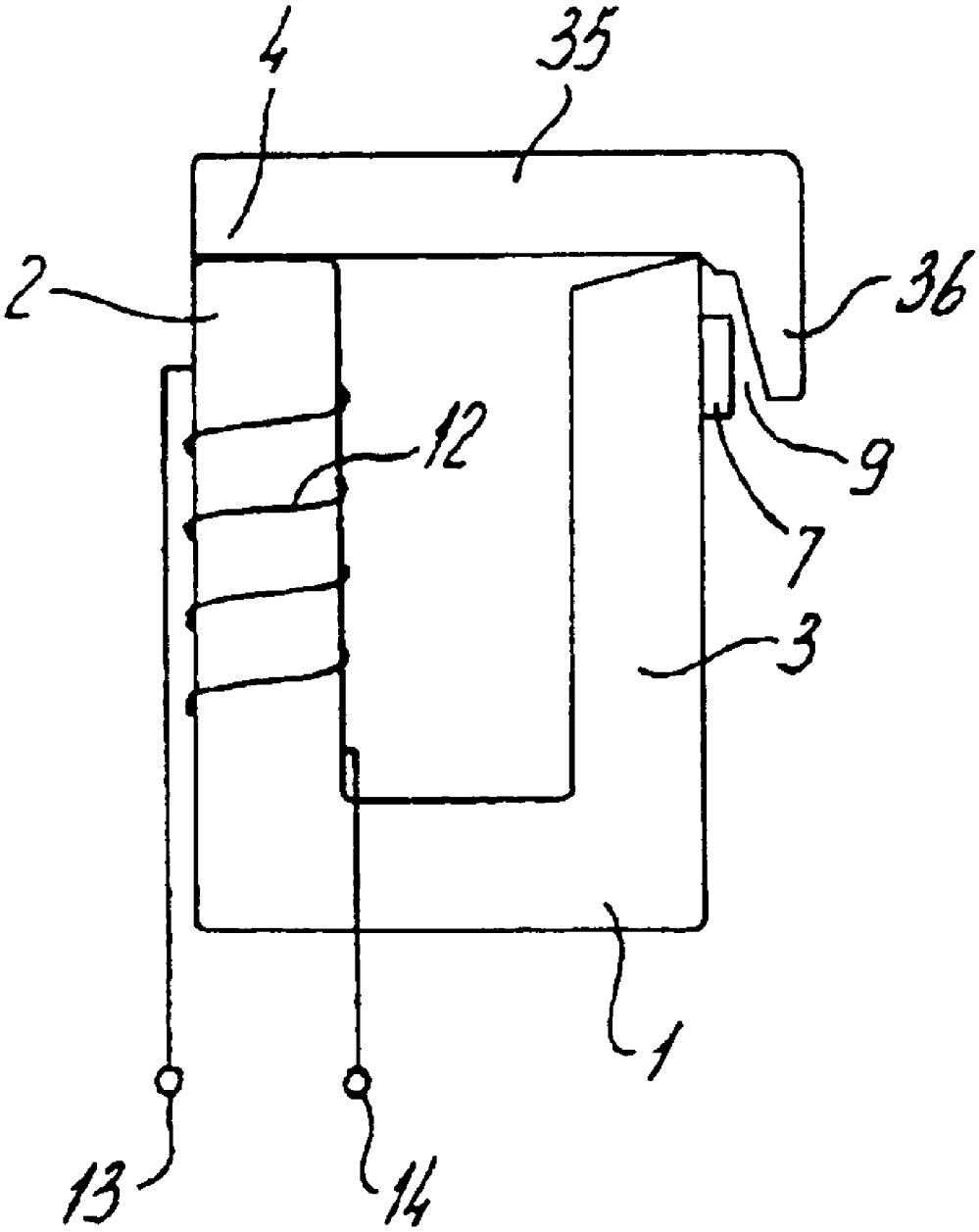
FIG. 5 shows a preferred embodiment of the trip system according to the invention.

In the embodiment shown in the FIGS. 1–4 at the one side and FIG. 5 at the other side, the solution for obtaining a second magnetic circuit is looked for in the shape of the yoke and the shape of the armature respectively. By using the second magnetic circuit it is possible to obtain an additional air gap varying in dimension such that the adverse variation of the spring means effective on the armature in the known trip system is eliminated or even overcompensated.

In the embodiment of FIG. 1 the second magnetic circuit is obtained in that the yoke of magnetic material further comprises a yoke base part extension 5 continuing as third yoke leg 6. A permanent magnet 7 is added to the yoke base part extension 5 and a third leg 6. This permanent magnet 7 is provided on the free end face of the third yoke leg 6. However, it is also possible to include the permanent magnet 7 anywhere in the yoke base part extension or in the third yoke leg 6. The armature 4 has an armature part 8 extending by such a distance beyond the supporting yoke leg 3, that this armature part 8 overlaps the free end of the permanent magnet 7, in which an air gap 9 remains in a position shown in FIG. 1 between the surfaces facing to each other of the armature part 8 and the permanent magnet 7.

The left hand end of the armature 4 lies against the free end face of the first yoke leg 2 in the so called closed position shown in FIG. 1. The armature 4 is holded by the permanent magnet 7 in this condition. The flux lines 10 originating from the permanent magnet 7 are distributed over the first yoke leg 2 and the supporting centre yoke leg 3. By the flux lines 10 a force is exerted on the said components at the location of the faces lying on each other of the armature 4 and the first yoke leg 2, by which the said faces are holded against each other. The compression spring 11 is biased in the closed condition of the trip system shown in FIG. 1 and a force is acting opposite to a force generated by the flux lines 10 at the location of the faces of armature 4 and first yoke leg lying on each other. The force originating from the bias of the compression spring 11 is, however, just not sufficient to pivot the armature 4 to the right.

The second supporting yoke leg 3 is provided with a coil 12. When the trip system is used with an earth leakage switch, a control current is supplied to the terminals 13 and 14 of the coil 12. This control current is directed such that in the second supporting yoke leg 3 flux lines 15 are established, which at the one side extend through the armature part 4, the first yoke leg 2 and the yoke base part 1 and at the other side through the armature part 8, the third yoke leg 6 and the yoke base part 5. The opposite flux 15 has a preference for leg 2 because of the air gap 9 and permanent magnet operating also as a air gap for flux 15. When a control current is sufficiently high and thus exceeds a predetermined limit value, the flux 10 is decreased by the oppositely directed flux 15 in the air gap 16, which is produced by the control current, so that by the bias of the compression spring 1 the armature 4, 8 may turn to the right, during which the mechanical energy accumulated in the compression spring 11 is used. Thereby a first air gap 16 is established between the surfaces facing to each other of the armature part 4 and the first yoke leg 2. The air gap 9 is thereby decreased. The effect of the compression spring 11 is decreased during turning. However, the air gap 9 is decreased during this turning and an increasingly greater force will act on the armature part 8 by the magnet 7 resulting from the decreasing air gap 9. By the effect of the decreasing air gap 9 a more or less hollow force-path characteristic of the trip system is obtained. The flux generated through the coil amplifies the field of the permanent magnet in the air gap 9.

By the trip system according to the invention the magnitude of the second air gap and the spring force of the compression spring are dimensioned such, that in the first position of the armature, the moment of the attracting force between armature and engaging yoke leg is bigger by a predetermined value than the sum of the moments of the attracting force at the second air gap and the spring force acting on the armature. The moments are defined with respect to a point, e.i. the pivot point of the armature on the supporting yoke leg 3. Said predetermined value is then dependent on the selected limit value of the coil current, above which the trip system must come to action.

The embodiment of the trip system according to the invention shown in FIG. 3 is assembled from a three-leg yoke from magnetic material and a pivotable armature, also from magnetic material. The armature 4 is supported pivotable or tiltable by the supporting yoke leg 3. This supporting yoke leg 3 is connected to the first and third yoke legs 2 and 6 respectively by the yoke base parts 1, 5.

The trip system has two stable conditions, an open condition in FIG. 3, in which the air gap 16 is opened and a closed condition in FIG. 1, in which the air gap 16 is closed. The closed condition of the armature 4 is also indicated by a dotted line in FIG. 3.

The first yoke leg 2 and the third yoke leg 6 have different lengths. The first yoke leg 2 could be shorter or longer than the supporting yoke leg 3, however, it is simpler in manufacturing when these two yoke legs have the same length. The armature engages the first yoke leg 2 and the supporting centre yoke leg 3 in the position shown by a dotted line.

The third yoke leg 6 is shorter than the other yoke legs, so that space remains between the free end face of the third yoke leg 6 and the armature 4 for accommodating a permanent magnet 7 and the armature part 8 in the closed condition of the trip system.

The magnetic field of the permanent magnet 7 is closed through the first yoke leg 2 and the second supporting yoke leg 3 and further through the third yoke leg 6 in the closed condition shown by a dotted line.

For the purpose of a well-defined and easy pivoting of the armature 4, 8 the free end face of the supporting yoke leg 3 is bevelled. Thereby a wedge-shaped air gap is produced in the closed condition of the trip system, so that a greater part of the flux generated by the permanent magnet flows through the air gap 16 than through the supporting leg 3.

The trip system is provided with spring means implemented as a compression spring in form of a leaf spring 17 as shown in FIG. 3. This leaf spring 17 could have a larger width than the armature 4, 8. Moreover the leaf spring may have different shapes depending on desired initial and end force. For example this leaf spring 17 could tapper or widen stepwise. Naturally also a coil spring is possible.

The leaf spring 17 engages at one end against the top side of the armature anywhere between the supporting yoke leg and third yoke leg. The other end of the leaf spring 17 is connected fixedly to the housing 18. The spring is clamped by means of a cam 28 against the cams 19 and 20 of the housing or fixed in another way in the housing. The leaf spring 17 biases the armature in the decreasing direction of the second air gap 9. The leaf spring 17 is fixed to the surface 19 of the housing 18. The leaf spring 17 engages the cam face 20 of the housing between its two ends. The leaf spring 17 defines an acute angle with the upper face of the armature 4, 8. This angle could also be zero in the second open condition. However, the space for the trips 21 must be taken into account. When the angle between leaf spring 17 and upper surface of the armature 4, 8 is zero in the closed condition, the inner wall should have a more complicated shape, in particular at the surfaces 19 and 20.

The leaf spring 7 is pushed away when the air gap 16 is closed and this leaf spring 17 is dimensioned such, that said spring compensates nearly the attracting force over the air gap 16, but not completely. Thereby the trip system is "sharpened".

The air gap between the armature part 8 and the permanent magnet 7 is nearly closed in the open condition, whereas the air gap 16 is opened. The leaf spring 17 exerted a selected end force in this open condition.

In order to come from the closed in the open condition a coil 12 having a coil holder 22 is provided on the supporting yoke leg 3. By energising said coil a flux is generated running in the same direction as the flux from the permanent magnet 7 between the surfaces facing to each other of the armature 4, 8 and permanent magnet 7.

The air gap 16 will be much smaller than the air gaps at the other end of the armature 4, 8 in the closed condition of the trip system, so that a higher flux produced by the coil will extend through the first yoke leg 2 than through the third yoke leg 6. The flux generated by the permanent magnet at the air gap 16 is counteracted by the flux produced by the coil. Thereby the magnetic attracting force over the air gap 16 will decrease and the armature will turn to the open condition under influence of the biased leaf spring 17.

During turning to the right of the armature 4, 8 the air gap 9 between the armature 4, 8 and the permanent magnet 7 will decrease more and more, so that the attracting force between armature and assembly of third yoke leg 6 and permanent magnet 7 increases. So that also the force on the trips 21 increases as the opening in the air gap 16 increases. Thus also in this case, the advantage of a more or less hollow force-path characteristic is achieved by which the main mechanism of the earth leakage switch can be unlocked more liable.

The yoke and the armature could be punched out from plate material in a known way. First the coil is placed around the supporting yoke leg. The yoke and the armature and the further components are placed subsequently in a plastic housing preferably divided longitudinally in two parts. In the assembling of the known trip system the magnet is placed in the housing, by which the magnetical system is sensitive to the magnetizable dust. Always some magnetizable dust adheres to a permanent magnet, unless this is mounted in a dust free space. The dust disturbs the good function of the trip system, because the air gap 16 may be contaminated. In order to remove said problems, the permanent magnet is provided in a recess of the housing, which recess is defined by the housing wall parts 23, 24 and 25. As said recess is accessible from the outside. The permanent magnet 7 can be shifted in said recess afterwards, i.e. after all of the other components are accommodated and closed in the trip system housing 18, and consequently it is possible to place the magnets under normal production circumstances, because dust eventually adhered cannot come into important air gaps.

The accuracy of the orientation of the end surface of the first yoke leg 2 with respect to the surface of the engaging armature 4 represents a problem in punching the yoke leg. The length of the first yoke leg 2 would be preferably exactly equal to the length of the supporting yoke leg 3. By punching or grinding the upper side of the first yoke leg 2 into a nearly convex shape, some tolerance as to the length of the first yoke leg 2 and the supporting yoke leg 3 is allowed. This is at the cost of the air gap 7 but does not disturb the good operation.

The third yoke leg 6 is reasonable width in connection to the dimensions of the permanent magnet 7. The coil holder 22 is bevelled at 26 to create space for the leaf spring 17. Further the coil holder 22 is provided with guiding means 27. The housing 18 is provided with guiding means 28 for guiding the armature 4, 8 when it pivots.

The armature 4, 8 have rounded comers at the end for matching in the housing and for preventing it from scraping against the housing. The comer 29 of the armature 4, 8 can be bevelled such that a larger engaging surface against the housing wall part 23 is produced, which bevelled surface can be used for tuning the attracting force over the air gap between said wall part and armature.

The housing is provided with a curved inner housing surface 30 with a predetermined radius for guiding the armature. This radius corresponds to the radius of the path travelled by the right hand end of the armature 4, 8 when it pivots. Because the inner wall surface 30 guides the engaging end of the armature, pivoting takes always place well defined and accurately.

Figure 2:
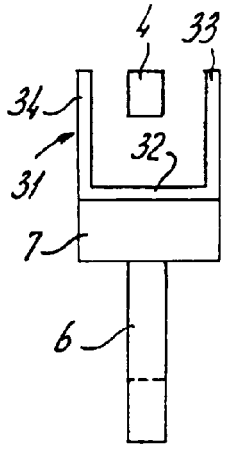
FIG. 2 represents a side view of the embodiment of FIG. 1.

It appears most clearly from FIGS. 2 and 4 that a U-shaped pole shoe 31 is added to the permanent magnet 7. The base part 32 of the pole shoe engages the surface of permanent the magnet 7 facing to the armature 8. The legs 33 and 34 extending perpendicular to the base part 32 of the pole shoes define with said base part 32 a space in which the armature 4 is accommodated.

By using the U-shaped pole shoe the air gap between armature and permanent magnet is decreased. The advantage thereof is that a smaller permanent magnet could be used.

The field lines in the closed condition, i.e. closed air gap 16, around the armature in air gap 9 exits horizontally in the direction to the U-shaped pole shoe. By this course of the field lines nearly no vertical attracting force on the armature occurs in this condition. The more the armature pivots further to the right, the vertical attracting force is bigger.

The U-shaped pole shoe is provided outside of the housing of the trip system as shown in FIG. 2. In this case the armature moves between the sidewalls of the housing 18.

The preferable embodiment shown in FIG. 5 comprises a two-leg yoke of magnetic material consisting of a first yoke leg 2 and a second supporting yoke leg 3. The trip system is further provided with an armature 4, supported pivotable by the supporting yoke leg 3. The armature has two legs 35 and 36 the one armature leg 35 of which bridging the space between the first yoke leg 2 and the supporting yoke leg 3. The armature leg 35 lies against the first yoke leg 2 in the closed condition shown in FIG. 5. The second armature leg 36 is substantially perpendicular to the armature leg 35 and defines with the surface facing to the supporting yoke leg 3 and the corresponding surface of the supporting yoke leg 3 a space in which the permanent magnet 7 is accommodated.

The yoke leg 2 is provided with a coil 12 having terminals 13 and 14.

In this embodiment the yoke is simpler, however, the shape of the armature 4 is somewhat more complex.

Because the permanent magnet 7 is placed transversely to the yoke leg 3 and the armature is extended in stead of the yoke, in this case by a part being squared, the air gap 9 could be made smaller by decreasing the distance of the permanent magnet 7 to the pivoting point of the armature. Thereby an even more compact construction is achieved. The field lines of the permanent magnet follow now a path via the supporting yoke leg 3, the yoke 1, the yoke armature part 35 and the extended part 36 of the armature.

The operation of this embodiment is in fact identical to that of the embodiment of the FIGS. 1 and 2.

Furthermore it is observed, that the permanent magnet may be provided with a U-shaped pole shoe also in this case.

What is claimed is:

1. Trip system for an electrical switch, comprising a yoke of magnetic material, consisting of a yoke base part, a first yoke leg and a second supporting yoke leg, said first and second yoke legs extend in a mutual spaced relation and in the same direction from the yoke base part and transversally thereto, an armature from magnetic material bridging the free ends of the yoke legs and pivotably supported by the supporting yoke leg, a permanent magnet provided such that its magnetic field lines extend through a first magnetic circuit formed by the yoke and the armature, a coil mounted on the yoke and spring means engaging the armature, in which the armature is held in a first position under influence of the magnetic field of the permanent magnet against the spring force of the spring means, in which the armature lies against the free end of the first yoke leg and in which the armature can assume a second position under influence of the magnetic field developed by a current flowing through the coil and exceeding a predetermined limit value, in which the surfaces facing to each other of the armature and the free end of the first yoke leg are at a first air gap distance from each other, characterised in that the magnet is included in a second magnetic circuit formed by the yoke and the armature and which in the first position of the armature has a magnetic resistance being higher than that of the first magnetic circuit and is decreasing when the armature moves from the first to the second position.

2. Trip system according to claim 1, characterised in that the yoke base part is provided with a yoke base part extension, extending beyond the supporting yoke leg and emerging into a third yoke leg running spaced from the supporting yoke leg and in the same direction thereof, that the permanent magnet is added to the magnetic path of the yoke base part extension and third yoke leg and that the armature is extended and the free end face of the assembly of the yoke base part extension, third yoke leg and permanent magnet overlaps at a second air gap distance when the armature is in the first position.

3. Trip system according to claim 1, characterised in that the armature has two legs, the one armature leg of which bridging the space between the first yoke leg and the supporting yoke leg and the second armature leg of which extending transversely to the one armature leg and at a distance from the supporting yoke leg, in which a space between the surfaces facing to each other of the second armature leg and the supporting yoke leg remains for accommodating the permanent magnet with a second air gap.

4. Trip system according to claim 2, characterised in that the magnitude of the second air gap and the spring force of the spring means on the armature are selected such that the first position of the armature the moment of the attracting force between the armature and the engaging yoke leg is bigger by a predetermined value than the sum of the moments of the attracting force at the location of the second air gap and the spring force acting on the armature, said moments are valid with respect to the armature pivoting point and that said value is related to the limit value of the coil current.

5. Trip system according to claim 1, characterised in that the free end face of the supporting yoke leg and the surface facing thereto of the armature define a wedge-shaped space.

6. Trip system according to claim 1, characterised in that the spring means are completely or partly released in the second armature position.

7. Trip system according to claim 2, characterised in that the spring means are constituted by a compression spring engaging the armature part between the supporting yoke leg and the third yoke leg and bias the armature in the direction of decreasing of the second air gap.

8. Trip system according to claim 7, characterised in that the compression spring is a leaf spring engaging at one end against the armature part between the supporting yoke leg and the third yoke leg and the other end is fixed at the other side in the housing of the trip system, in which in a position differing from the second position of the armature a leaf spring and the armature defines an angle.

9. Trip system according to claim 8, characterised in that the leaf spring engages a cam of the housing between the fixed end and the free end of the leaf spring.

10. Trip system according to claim 1, characterised in that the permanent magnet is accommodated in a recess in a house wall located between the free end face of the third yoke leg and the armature surface facing thereto.

11. Trip system according to claim 10, characterised in that the recess is accessible from the outside.

12. Trip system according to claim 1, characterised in that the supporting yoke leg and the first yoke leg has substantially the same length.

13. Trip system according to claim 1, characterised in that the free end face of the first yoke leg is rounded.

14. Trip system according to claim 1, characterised in that the housing and coil holder are provided with mechanical guiding faces for the armature.

15. Trip system for an electrical switch, comprising a yoke of magnetic material, consisting of a yoke base part, a first yoke leg and a second supporting yoke leg, said first and second yoke legs extend in a mutual spaced relation and in the same direction from the yoke base part and transversally thereto, an armature from magnetic material bridging the free ends of the yoke legs and pivotably supported by the supporting yoke leg, a permanent magnet provided such that its magnetic field lines extend through a first magnetic circuit formed by the yoke and the armature, a coil mounted on the yoke and spring means engaging the armature, in which the armature is held in a first position under influence of the magnetic field of the permanent magnet against the spring force of the spring means, in which the armature lies against the free end of the first yoke leg and in which the armature can assume a second position under influence of the magnetic field developed by a current flowing through the coil and exceeding a predetermined limit value, in which the surfaces facing to each other of armature and free end of the first yoke leg are at a first air gap distance from each other, characterised in that the magnet is included in a second magnetic circuit formed by the yoke and the armature and which in the first position of the armature has a magnetic resistance being higher than that of the first magnetic circuit and is decreasing when the armature moves from the first to the second position, and in that the armature has rounded corners at the ends.

16. Trip system according to claim 1, characterised in that the armature part lies against the free end of the assembly of yoke base part extension, third yoke leg on permanent magnet with a bevelled surface in the second armature position.

17. Trip system for an electrical switch, comprising a yoke of magnetic material, consisting of a yoke base part, a first yoke leg and a second supporting yoke leg, said first and second yoke legs extend in a mutual spaced relation and in the same direction from the yoke base part and transversally thereto, an armature from magnetic material bridging the free ends of the yoke legs and pivotably supported by the supporting yoke leg, a permanent magnet provided such that its magnetic field lines extend through a first magnetic circuit formed by the yoke and the armature, a coil mounted on the yoke and spring means engaging the armature, in which the armature is held in a first position under influence of the magnetic field of the permanent magnet against the spring force of the spring means, in which the armature lies against the free end of the first yoke leg and in which the armature can assume a second position under influence of the magnetic field developed by a current flowing through the coil and exceeding a predetermined limit value, in which the surfaces facing to each other of armature and free end of the first yoke leg are at a first air gap distance from each other, characterised in that the magnet is included in a second magnetic circuit formed by the yoke and the armature and which in the first position of the armature has a magnetic resistance being higher than that of the first magnetic circuit and is decreasing when the armature moves from the first to the second position, and in that one end of the armature engages a curved house part during the pivoting movement of the armature, the radius of said curvature corresponds to the radius of the path covered by the end of the armature located above the third yoke leg.

18. Trip system according to claim 1, characterised in that the permanent magnet is provided at its surface facing to the armature with a U-shaped pole shoe, the base of which extending parallel to said surface of the permanent magnet and the legs of which are running perpendicular to and in a direction of the said surface, in which the armature is accommodated movable in a space defined by the base and the legs.

* * * * *